United States Patent [19]

Schmitz

[11] 3,961,833

[45] June 8, 1976

[54] STRAIN RELIEF

[75] Inventor: James E. Schmitz, Racine, Wis.

[73] Assignee: Andis Clipper Company, Racine, Wis.

[22] Filed: Jan. 29, 1975

[21] Appl. No.: 545,096

[52] U.S. Cl. ..... 339/119 R

[51] Int. Cl.[2] ..... H01R 13/58; H01R 13/60

[58] Field of Search ..... 339/59 R, 108 R, 103 R, 339/103 B, 103 C, 119 R, 119 C

[56] References Cited

UNITED STATES PATENTS

| | | | |
|---|---|---|---|
| 2,869,094 | 1/1959 | Francis | 339/59 R |
| 3,163,882 | 1/1965 | Falkenberg | 339/103 B X |

FOREIGN PATENTS OR APPLICATIONS

| | | | |
|---|---|---|---|
| 951,673 | 3/1964 | United Kingdom | 339/103 R |

*Primary Examiner*—Roy Lake
*Assistant Examiner*—Howard N. Goldberg
*Attorney, Agent, or Firm*—Michael, Best & Friedrich

[57] ABSTRACT

Disclosed herein is an electrical apparatus comprising a housing having an aperture extending between an inner and an outer surface, an electrical cord including an inner wire and an outer sheath including a strain relief portion comprising a first enlarged part engaging the housing outer surface and a second enlarged part of lesser size than the first enlarged part, extending through the aperture and including therein, inwardly of the housing inner surface, a groove extending at least partially peripherally of the second enlarged part, a U-shaped retaining clip received in the groove and including a surface engagable with the housing inner surface to prevent withdrawal of the cord through the aperture, a cover removably secured to the housing and preventing withdrawal of the clip from said groove, and edges on the clip and walls on the housing and cord engaging the clip edges for preventing relative rotation between the cord and the housing.

4 Claims, 5 Drawing Figures

STRAIN RELIEF

BACKGROUND OF THE INVENTION

The invention relates generally to electrical appliances including a motor housing or the like, and an electrical cord which enters into the housing. More particularly, the invention relates to strain relief arrangements in connection with such cords and housings.

Attention is directed to the Falkenbert U.S. Pat. No. 3,163,882 issued Jan. 5, 1965 and to the U.S. Francis Pat. No. 2,869,094 issued Jan. 13, 1959.

SUMMARY OF THE INVENTION

The invention provides an electrical apparatus comprising a housing having an outer surface, an inner surface, and an aperture extending in the housing between the inner and outer surfaces, together with an electrical cord comprising an inner wire and an outer covering including a strain relief portion comprising a first enlarged part engaging the housing outer surface and a second enlarged part of lesser size than the first enlarged part, extending through the aperture, and including therein, inwardly of the inner surface, a groove extending at least partially peripherally of the second enlarged part, a retaining clip received in the groove and including a surface engagable with the inner housing surface to prevent withdrawal of the cord through the aperture, means on the housing for preventing withdrawal of the clip from engagement in the groove, and means for preventing relative rotation between the cord and the housing.

In accordance with one embodiment of the invention, the means for preventing relative rotation between the cord and the housing comprises means on the clip and on the cord for preventing relative rotation therebetween, and means on the clip and on the housing for preventing relative rotation therebetween. More specifically, in accordance with one embodiment of the invention, the clip is U-shaped including two-spaced parallel legs, the groove includes two parallel inner surfaces engaged by the inner surfaces of the legs to prevent relative rotation therebetween and the inner housing surface includes a recess having spaced parallel sidewalls engaged by the outer edges of the legs to prevent relative rotation between the clip and the housing.

In accordance with an embodiment of the invention, the housing has an opening extending laterally with respect to the aperture and adapted to permit passage therethrough of the clip for insertion into the groove, together with a side plate or cover removably closing the opening, and the means preventing withdrawal of the clip from the groove comprises means on the clip and on the cover in engagement when the cover is connected to the remaining portion of the housing so as thereby to prevent clip removal from the groove.

In accordance with an embodiment of the invention, the clip is generally of U-shape and is bowed in the direction transversely of the direction of the legs.

One of the principal features of the invention is the provision of a strain relief arrangement for an electrical appliance, which arrangement is economical to manufacture, easy to assemble, and which will provide reliable service over a long and useful life.

Other features and advantages of one embodiment of the invention will become known by reference to the following drawings, general description and claims.

THE DRAWINGS

Figure 1:
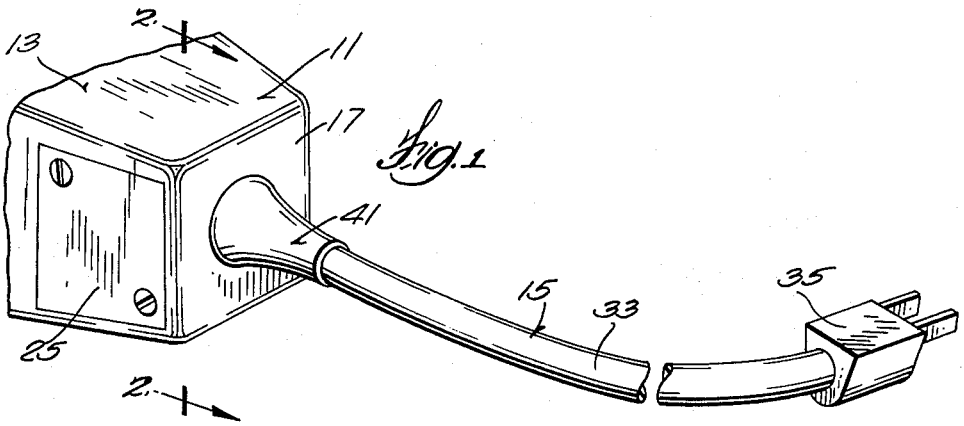
FIG. 1 is a fragmentary perspective view of an electrical appliance which includes a hollow housing and an electrical cord and which incorporates various of the features of the invention.

Before explaining the electrical appliance in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purpose of description and should not be regarded as limiting.

GENERAL DESCRIPTION

Shown in the drawings is an electrical appliance 11 which can take various forms, as for instance, an electrically powered hair clipper, and which includes a housing 13 and an electrical cord 15 extending into the housing 13.

More specifically, the housing 13 can be suitably fabricated from any desired material in any desired way to include an outer surface 17, an inner surface 19 defining an interior void or chamber 21 for an operating motor or other mechanism or otherwise, and an aperture or bore 23 extending through the housing 13 between the inner and outer surfaces 19 and 17 and adapted for passage therein of the electrical cord 15. The housing preferably includes, as shown, a removable side panel or cover 25 affording access to the interior chamber 21.

The cord 15 is elongated and can include one or more electrical wires 31 (three in the illustrated construction) which are preferably separately insulated from one another and which preferably are contained in an outer sheath 33 of insulating material. At its outer end, the cord 15 can include a plug 35 and, at its inner end, the wires 31 can include terminals facilitating connection to an electrical motor or other device mounted in the housing.

In accordance with the invention, the cord 15 also includes an enlarged strain relief portion 41 which desirably is fused on the outer sheath 33 and which includes a first enlarged part 43 extending lengthwise of the cord 15 and flaring outwardly to define a transverse shoulder or surface 45 engagable with the housing outer surface 17 around the edge of the aperture 23. The strain relief portion 41 also includes another part 47 enlarged with respect to the outer sheath 33 but of lesser size than the flaring part 43 so as to form a shoulder which provides the surface 45. The second enlarged part 47 extends through the aperture 23 and is generally of slightly smaller cross section than the aperture 23. In cross section, the aperture 23 and the enlarged second part 47 can be generally circular. In the illustrated construction, the strain relief portion 41 is located adjacent to the inner end of the cord 15.

The enlarged second part 47 of the strain relief portion 41 extends inwardly of the housing beyond the housing inner surface 19 and includes a groove 49 extending at least partially peripherally around the enlarged second part 47.

Received in the groove 49 is a retaining clip 51 which, in the illustrated construction, is generally of U-shape and which includes a web portion 53 and a pair of generally spaced and parallel legs 55, as well as a surface 57 engaging the inner surface 19 of the housing 13 to thereby prevent withdrawal of the cord 15 from the housing 13 when the clip 51 is engaged in the groove 49.

Means are also provided for preventing withdrawal of the clip 51 from the groove 49. While other arrangements can be employed, in the illustrated construction, the housing slide plate or cover 25 engages the edge 59 of the web portion 53 of the clip 51 when the slide plate or cover 25 is attached to the remainder of the housing 13, thereby preventing withdrawal of the clip 51 from the groove 49.

Means are also provided for preventing relative rotation between the cord 15 and the housing 13. While various other constructions could be employed, in the illustrated construction, means are provided for preventing relative rotation between the clip 51 and the cord 15 and for preventing relative rotation between the clip 51 and the housing 13.

Figure 2:
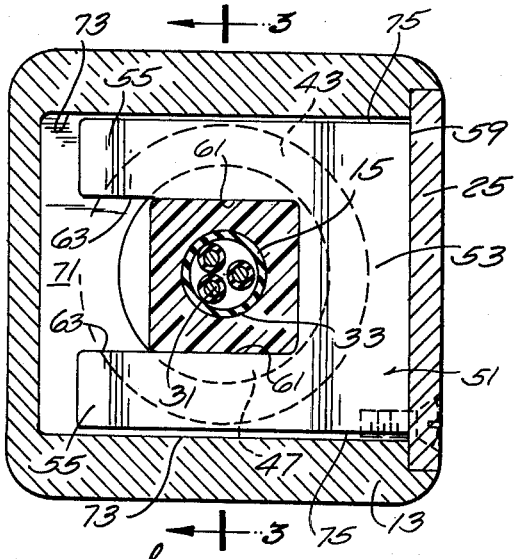
FIG. 2 is an enlarged sectional view taken along line 2—2 of FIG. 1.
Figure 3:
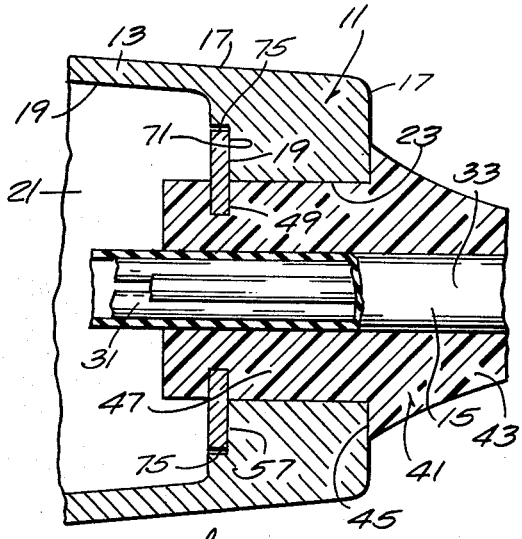
FIG. 3 is an enlarged sectional view taken along line 3—3 of FIG. 2.
Figure 4:
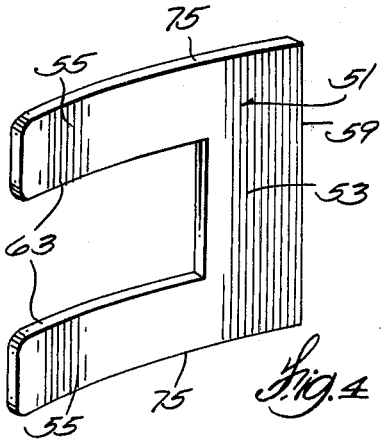
FIG. 4 is a perspective view of one of the components incorporated in the appliance shown in FIG. 1.

The means for preventing relative rotation between the clip 51 and the cord 15 comprise formation of the groove 49 with spaced parallel inner surfaces or walls 61 adapted to be engaged by the parallel inner edges 63 of the spaced legs 55 of the U-shaped clip 51. Thus, as shown in FIG. 2, the groove 49 extends continuously around the enlarged second part 47 of the strain relief portion 41 and the inner surface 61 is of square outline and is dimensioned to be easily but snuggly received between the legs 55 of the clip 51 so as to prevent relative rotation therebetween.

The means for preventing relative rotation between the clip 51 and the housing 13 comprises formation of the housing inner surface 19 with a recess 71 which communicates directly with the aperture 23 and which includes spaced parallel side surfaces or walls 73 adapted to easily but snuggly receive the outer edges 75 of the legs 55 of the U-shaped clip 51 so as to prevent relative rotation between the clip 51 and the housing 13. If desired, the recess 71 can be omitted and the inner surface 19 of the housing 13 can be formed to directly engage the outer edges 75 of the legs 55 of the clip 51 so as to prevent relative rotation between the clip 51 and the housing 13.

Engagement of the clip 51 in the groove 49 retains the clip 51 in the recess 71 against movement in the direction of the length of the cord 15, while also preventing withdrawl of the cord 15 from the aperture 23. In addition, as already pointed out, the removable side plate or cover 25 prevents lateral outward movement of the clip 51 from the recess 71.

If desired, relative rotation between the cord 15 and the housing 13 can be provided by forming the aperture 23 with a non-circular cross section and by forming the strain relief portion 41 with a mating non-circular cross section. Under such circumstances, the clip 51 could be of such construction as would permit relative rotation between the clip 51 and the strain relief portion 41 and to permit relative rotation between the clip 51 and the housing 13 but means would still be employed to prevent withdrawal of the clip 51 from engagement with the groove 49.

Figure 5:
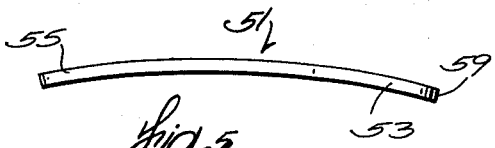
FIG. 5 is a transverse view of the component shown in FIG. 4.

Preferably, the clip 51 is slightly bowed as shown in FIG. 5 in the direction transverse to the length of the legs 55 so as to permit assembly of the clip 51 in the recess 71 with the bow either toward or away from the housing inner surface 19 so as thereby to accommodate variation in manufacturing tolerances with regard to the length of the aperture 23 and the distance of the groove 49 from the shoulder 45. Thus, the clip 51 can be inserted into the groove 49 to minimize sloppiness. Alternatively, if desired, the clip 51 can be bowed in the direction along the edge 59.

In assembly, the cord 15 is inserted through the aperture 23 in the housing 13 until the shoulder or surface 45 engages the housing outer surface 17. Thereafter, the clip 51 is laterally inserted into the recess 71 and into the groove 49 so as simultaneously to prevent withdrawal of the cord 15 through the aperture 23 and to prevent relative rotation between the clip 51 and each of the cord 15 and the housing 13. Thereafter, the side panel 25 is attached to the remainder of the housing 13 to prevent lateral withdrawal of the clip 51 from the groove 49 in the strain relief portion 41. As a consequence, the cord 15 is fixed to the housing 13 against relative rotary movement and against relative movement in the direction of the length of the cord 15.

Various of the features of the invention are set forth in the following claims.

I claim:

1. An electrical apparatus comprising a housing having an outer surface, an inner surface forming one wall of an interior chamber, an aperture extending in said housing between said inner and outer surfaces and communicating with said chamber, and an opening extending laterally with respect to said aperture and communicating with said chamber, an electrical cord including an inner wire and an outer sheath including a strain relief portion comprising a first enlarged part engaging said housing outer surface and a second enlarged part of lesser size than said first enlarged part, extending through said aperture and including therein inwardly of said housing inner surface and within said chamber, a groove extending at least partially peripherally of said second enlarged part, a retaining clip adapted for passage through said opening, received in said groove, and including a surface engageable with said housing inner surface to prevent withdrawal of said cord through said aperture, a cover removably closing said opening and preventing lateral withdrawal of said clip from said groove, and means for preventing relative rotation between said cord and said housing.

2. An electrical appliance in accordance with claim 1 wherein said means for preventing relative rotation between said cord and said housing comprises means on said clip and on said cord for preventing relative rotation therebetween and means on said clip and on said housing for preventing relative rotation therebetween.

3. An electrical appliance in accordance with claim 2 wherein said clip is U-shaped including two spaced parallel legs, wherein said groove includes two parallel inner surfaces engaged by the inner edges of said legs and wherein said housing inner surface includes a recess having spaced parallel side walls engaged by the outer edges of said legs.

4. An electrical appliance in accordance with claim 1 wherein said clip is generally U-shaped including two spaced and parallel legs and wherein said clip is bowed in the direction transversely of the length of said legs.

* * * * *